US005547235A

United States Patent [19]

Dziuk et al.

[11] Patent Number: 5,547,235

[45] Date of Patent: Aug. 20, 1996

[54] GEARING FOR A DOOR LOCK, IN PARTICULAR FOR A PANIC OR SMOKE-PROTECTION DOOR LOCK

[75] Inventors: Richard Dziuk, Arolsen; Horst Jäger, Edertal-Buhlen, both of Germany

[73] Assignee: HEWI Heinrich Wilke GmbH, Arolsen, Germany

[21] Appl. No.: 4,988

[22] Filed: Jan. 15, 1993

[30] Foreign Application Priority Data

Jan. 17, 1992 [DE] Germany ..... 42 01 070.5

[51] Int. Cl.[6] ..... F05B 65/10

[52] U.S. Cl. ..... 292/92; 292/336.3

[58] Field of Search ..... 292/336.3, 279, 292/92

[56] References Cited

U.S. PATENT DOCUMENTS

| | | | |
|---|---|---|---|
| 1,815,584 | 7/1931 | Prinzler | 70/92 |
| 2,991,107 | 4/1961 | Eichacker et al. | 292/92 |
| 3,869,159 | 3/1975 | Eads | 292/92 |
| 3,894,759 | 7/1975 | Balducci | 292/92 |
| 4,123,097 | 10/1978 | Allemann | 292/336.3 |
| 4,915,432 | 4/1990 | Gressett | 292/336.3 |
| 4,982,986 | 1/1991 | Gressett et al. | 292/165 X |
| 5,083,822 | 1/1992 | Mangin et al. | 292/92 X |

FOREIGN PATENT DOCUMENTS

| | | |
|---|---|---|
| 0113655 | 12/1983 | European Pat. Off. . |
| 1024836 | 4/1954 | France . |
| 2292835 | 6/1976 | France . |
| 3116706 | 11/1982 | Germany . |
| 8526748 | 9/1985 | Germany . |
| 3533361 | 8/1986 | Germany . |
| 8808114 | 9/1988 | Germany . |
| 2167116 | 5/1986 | United Kingdom . |

*Primary Examiner*—Jerry Redman
*Attorney, Agent, or Firm*—Michael J. Striker

[57] ABSTRACT

A gearing is described for locks of panic doors. The gearing has a first gearing part (17)which is rotatable around a first axis (17*a*) and can be connected with an actuating member (18) for a lock nut or the like, and a second gearing part (28) which is rotatable around a second axis perpendicular to the first axis and is connected with a handle (1). One of the gear parts is provided with a driver pin (24) arranged parallel to and at a distance from the first axis and the other gearing part is provided with a guide part cooperating with the latter for the purpose of converting the rotating movement of the handle (1) into a rotating movement of the actuating member (18).

23 Claims, 7 Drawing Sheets

GEARING FOR A DOOR LOCK, IN PARTICULAR FOR A PANIC OR SMOKE-PROTECTION DOOR LOCK

BACKGROUND OF THE INVENTION

The invention is directed to a gearing for a door lock, having a lock follower or the like-(hereinafter simply called lock nut) and an actuating member therefor, particularly a panic or smoke-protection door lock. The gearing comprises a first gearing part being rotatable around a first axis and being connectable with said actuating member and a second gearing part which is rotatable around a second axis and is to be connected with a handle.

Doors are sometimes provided with handles whose rotation or swivel axes, in contrast to the axes of the lock nuts or the like of most latch and/or bolt locks, are not substantially perpendicular to the door leaf when the handles are mounted. Such doors are chiefly so-called panic doors which are provided, for instance, in public buildings or public entertainment locations such as cinemas or the like so as to provide, in cases of emergency, an escape route with an outwardly opening door which can be easily and reliably opened also during the outbreak of panic. For this purpose, the handles of these panic doors have handle bars which extend substantially along the entire width of the door and are arranged on the inside of the door and can be swiveled by hand or body pressure in the direction of a door leaf around a substantially horizontal axis in the mounted state and accordingly pull back the bolt as well as the latch of the respective door lock. The outside of panic doors is either completely smooth or provided with conventional handles in the form of latch handles, knobs or the like and possibly with keys for the locking bolt. Apart from emergency situations, such panic doors can also be advantageous for other purposes and are used, for instance, in hospitals or wherever there is the desire to open a door e.g. by the pressure of the arm or body. In such cases, an additional bolt can usually be dispensed with.

In addition, there are so-called smoke-protection doors which were previously constructed as swinging doors and provided with handle bars which are rigidly attached and arranged in the mounted state so as to be substantially vertical. In the future such smoke-protection doors will have to be constructed with latch locks and therefore also with swivelable handles. It may therefore be desirable to provide smoke-protection doors with handles which are arranged as swinging door handles which are swivelable substantially around a vertical axis when mounted.

Since the described handles are swiveled around axes which must be substantially perpendicular to the rotational axis of the lock nut, a gearing must be associated with the handles and locks which converts the rotational movement around the swivel axis of the handle into a rotational movement around the rotational axis of the lock nut perpendicular thereto. Numerous demands are made on such a gearing. First, the latch and the bolt must be drawn back completely by a swiveling movement of the handle e.g. by 30° or 45°. Further, it must be possible to unlock by exerting a slight predetermined pressure on the handle. Finally, it is desirable to provide such a gearing in doors with a continuous door leaf, e.g. fire doors, as well as in frame doors or the like in which the door leaf is produced predominantly from glass or the like and is enclosed only by a narrow frame, often with a width of only 42 mm, at which the handle must be mounted. Therefore, the gearing must be sufficiently stable and as frictionless as possible on the one hand, but must have a sufficiently small width on the other hand.

A known gearing of the generic type indicated in the introduction (EP 0 113 655 B2, DE 85 26 748 U1) in particular does not satisfy these last requirements. This is because the gearing is arranged adjacent to a sleeve for receiving a conventional actuating member for the lock nut, e.g. a square spindle, and therefore coaxially relative to it, has means in the form of driver pins and guides which act on the latter and are arranged radially outside of the sleeve contour. A small width of the overall construction is therefore still synonymous with poor stability. On the other hand, if the object is high stability-and accessibility so that all of the above-mentioned demands are satisfied, this necessarily requires a width of the overall arrangement which is so large as to render it unsuitable at least for frame doors with conventional frame widths and spindle dimensions (distance of the lock nut axis from the end face of the door or frame when the door is closed). In addition to this, there is also a risk when using the known gearing that the height of the overall arrangement perpendicular to the door leaf is so great that the door can no longer be opened outward when using conventional spindle dimensions because the gearing arrangement would strike against the frame or its lining.

SUMMARY OF THE INVENTION

The invention therefore has the object of constructing the gearing in such a way that it has a comparatively narrow and flat construction.

A further object of this invention is to construct the gearing in such a way that it has a comparatively narrow and flat construction while still having sufficient stability.

Yet another objection of this invention is to construct the gearing in a flat and narrow manner but also such that it can be actuated by a slight pressure on the handle.

To meet these and other objects the invention is characterized in that for the purpose of converting the rotational movement of the handle into a rotational movement of the actuating member in at least one rotation direction one of the gearing parts is provided with a driver pin which is arranged parallel to and at a distance from the first axis and the other gearing part is provided with a guide part cooperating with the driver pin.

The invention is based on the surprising understanding that particularly narrow, yet stable gearing constructions can be realized on the basis of the novel arrangement of the driver pin regardless of whether or not the swivel axis of the handle is arranged substantially horizontally or vertically in the installed state. A gearing of this type is therefore suitable especially for panic or smoke-protection doors constructed as frame doors, although they are of course also suitable for all of the other purposes mentioned in the preceding.

The invention is explained in more detail in the following in connection with the attached drawing with reference to embodiment examples.

DESCRIPTION OF THE PREFERRED EMBODIMENTS

Figure 1:
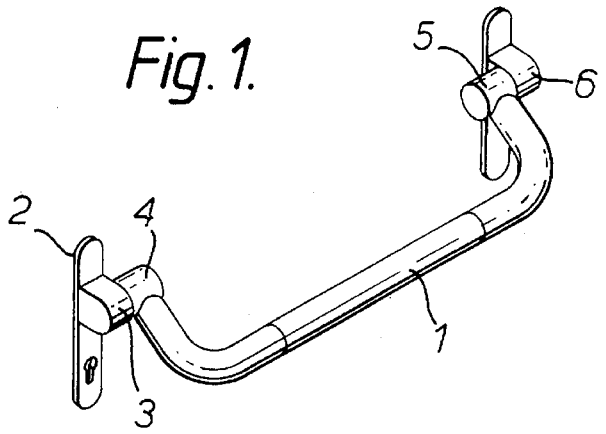
FIG. 1 shows a perspective view of a complete handle mounting which is particularly suitable for a panic door.
Figure 2:
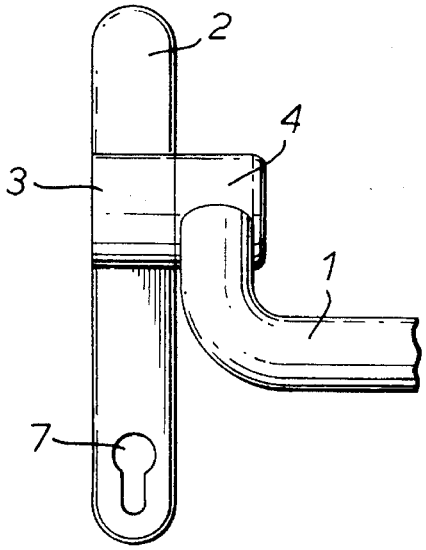
FIGS. 2 and 3 show a front and side view of the mounting, respectively.
Figure 3:
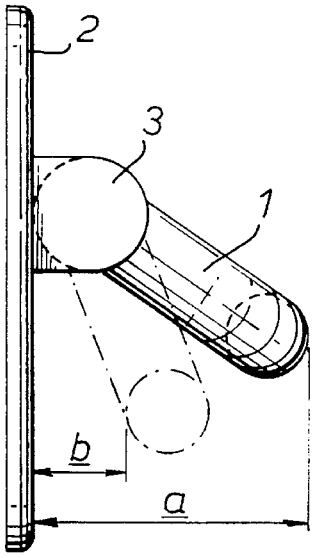

FIGS. 1 to 3 are schematic views of a handle mounting for a panic door. The left-hand side of FIG. 1 shows the part of the mounting acting on a door lock, not shown, and holding one end of a handle 1 and the right-hand side of FIG. 1 shows the part of the mounting holding the other end of the handle 1. The mounting contains a conventional door plate 2 which is constructed e.g. as a longitudinal plate and has a rigidly arranged holder part 3 for a gearing and a receptacle 4 for the handle 1, which receptacle 4 is rotatably supported at the holder part 3. The handle 1 is constructed as a handle bar extending substantially along the entire width of the door or along at least two thirds of it. The other end of the handle 1 is fastened at a second receptacle 5 which is rotatably supported in another rigid holder part 6. The door plate 2 has an opening 7 for a profile lock cylinder or the like at its other end.

A regulation in doors of this type consists e.g. in that the maximum distance a of the handle 1 in the rest position shown in solid lines must be approximately 100 mm and the smallest distance in the fully depressed operating position shown in dashed lines must be approximately 25 mm. Therefore, the latch and the bolt of the respective door lock must be in the fully opened position after a movement of the handle 1 from distance a to distance b in the direction of the door. Door locks in which this can be effected by a rotational movement of the conventional lock nut by e.g. 30° or 45° are generally known and therefore need not be discussed at greater length.

Figure 4:
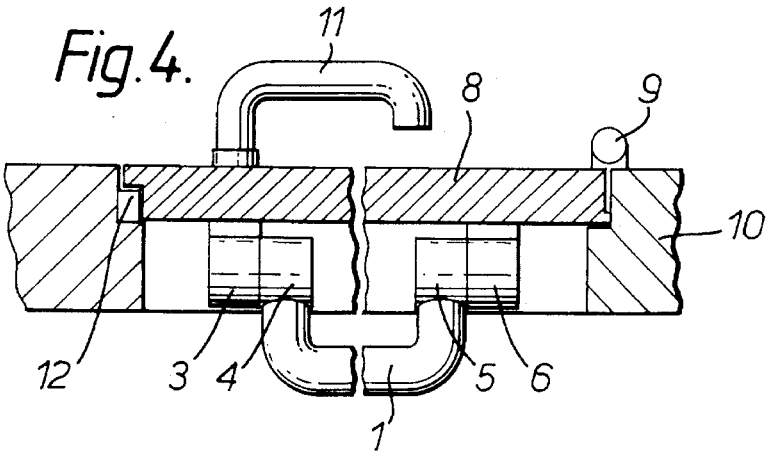
FIG. 4 Shows a cross section through a panic door and the adjacent frame.

FIG. 4 is a schematic view of a door 8 which is hung on a frame 10 by means of a hinge plate 9. The door 8 is provided on its inner side with the handle 1, while a conventional latch handle 11 is mounted on its outside. While the latch handle 11 acts only on a latch 12 as a rule, a swiveling of the handle 1 in the direction of the door 8 acts on the latch 12 as well as on a bolt, not shown. Both the handle 1 as well as the latch handle 11 act on an actuating member for the door lock which penetrates the door.

In the handle mounting according to the invention, which is shown in FIGS. 5 to 9 and has so far been considered the best solution, the door plate 2 contains a holder part 3 in the form of a lower part having a mounting plate 15 with screw holes 14 for mounting on the door and an outer cover which is designated in its entirety by 16. The mounting plate 15 is provided with a circular opening in which a rear cylindrical portion of a first gearing part in the form of a driver sleeve 17 is supported so as to be rotatable around a first axis 17*a*. The driver sleeve 17 has a non-circular, preferably square, inner cross section and serves to receive an actuating member 18 having a correspondingly non-circular outer cross section, preferably a conventional square spindle which penetrates a lock nut and can be fastened in the driver sleeve 17 so as to be fixed with respect to axial displacement by means of a radially arranged fastening screw 19. To provide the driver sleeve 17 with a sufficiently secure fit in the comparatively flat mounting plate 15, a bearing bush 20 is inserted in its opening which is supported at the inside of the mounting plate 15 by a collar 21 and can be securely connected with it by welding or the like. The driver sleeve 17 has a radially projecting arm 22 at its inner end and is supported at the collar 21 by one end, while being axially secured by a spring ring 23 at its other end which projects out of the bearing bush 20.

A driver pin 24 whose axis is arranged parallel to and at a distance from the first axis 17*a* is fastened at the free end of the arm 22 and preferably projects perpendicularly from the inner end face of the driver sleeve 17, which inner end face is parallel to the mounting plate 15.

Further, the lower part has two parallel holding plates 26 which project substantially perpendicularly from the mounting plate 15 and between which the driver sleeve 17 is arranged in such a way (FIG. 5) that its arm 22 can be moved in a reciprocating manner around a preselected angle of rotation, e.g. 30° or 45°. The two holding plates 26 have coaxial bearing bore holes 27 (FIG. 5) for the rotatable support of a second gearing part which is preferably constructed as a cylindrical roller 28. The second gearing part is rotatable around a second axis 29 which is preferably substantially perpendicular to the first axis 17*a* and arranged substantially horizontally according to FIG. 7 in the mounted state of the mounting when the actuating member 18 is perpendicular to the door leaf, as is conventional. The roller 28 shown in an enlarged view in FIGS. 8 and 9 has at least one cut out portion 30 in its outer surface area into which the driver pin 24 projects and whose upper side is defined in the embodiment example by a wall portion constituting a guide part 31 for the driver pin 24. This guide part 31 is arranged at an inclination relative to the second axis 29 and is preferably constructed as a straight-line guide, although it could also extend in an arc-shaped manner and be directed toward either side of the center plane 32 of the roller 28 as is indicated by solid and dashed lines 31, 31*a*. The driver pin 24 can accordingly be swiveled into the operating position shown in solid lines by rotating the roller 28 out of its center position indicated in dashed lines in FIG. 5 which corresponds to the rest position. However, this rotating movement is only possible because the two axes 17*a*, 29 corresponding to FIG. 6 are at a distance from one another without intersecting one another such that the axis 29 is situated approximately at the height of the axis of the driver pin 24.

The rotation of the roller 28 is effected by the handle 1 which has a pin 35 at one end which projects perpendicularly from its end face and is coupled with a rod 36 projecting through a coaxial passage of the roller 28 so as to be fixed with respect to rotation relative to it. The rod 36 is connected with the widened receptacle 4 (see also FIG. 1) at its part projecting out of the roller 28. The receptacle 4 has a transverse bore hole 38 receiving the pin 35 and an axial bore hole for a fastening screw 39. The rod 36 in turn is connected so as to be fixed with respect to rotation and axial displacement by a fastening screw 40 which penetrates the rod 36 and the roller 28 transversely, so that a rotating movement of the handle 1 is transmitted to the actuating member 18 in at least one rotating direction via the roller 28, the guide part 31 acting on the driver pin 24, and the driver sleeve 17. The rod 36 has a preferably cylindrical shape and the roller 28 is provided with a cylindrical passage. Further, the rod 36 can simultaneously be supported in the bearing bore holes 27 so as to be rotatable and can accordingly support the roller 28 so as to be rotatable, for which purpose the latter must also be connected with the rod 36 by the fastening screw 40 so as to be fixed with respect to rotation relative to it. Alternatively, the roller 28 can be penetrated by an additional bearing sleeve 41 which projects into the bearing bore holes 27 and receives the rod 36. In this case the fastening screw 40 must also radially penetrate the bearing sleeve 41 so as to achieve the required protection against rotation and so as to be secured axially.

In panic doors or the like it is normally sufficient to actuate the actuating member 18 only so as to open the latch and/or the bolt since the door is generally locked from the outside. Moreover, a pair of rollers 28 with one of the two guide parts 31, 31*a* (FIG. 8) which can be used optionally for doors opening to the right or to the left can be associated with the gearing. A driver sleeve whose driver pin is correspondingly offset can be associated with the roller having the cut out portion 30*a*. It would also be possible to install the driver sleeve 17 in a position which is rotated by approximately 180° relative to FIG. 5 and to install the roller 28 in a corresponding manner in a position rotated by 180° around the first axis 17*a*. Alternatively, the cut out portion 30, 30*a* could be constructed as a straight or arc-shaped elongated hole guiding the driver pin 24 at both sides. In either case, the gear ratio of the rotating movement to be converted or the gear ratio between the two gearing parts 28 and 17 can be adjusted by the angle enclosed by the guide parts 31, 31*a* with the second rotational axis 29.

The outer cover 16 contains a rigidly arranged portion 42 which is associated with the holder part 3 in a fixed manner and is open at the side (FIG. 7) to enable a mounting of the receptacle 4 and the rod 36. The outer cover 16 further contains a portion 43 which is rotatably connected with the portion 42 and mounted on the receptacle 4, and a portion 44 which is pressed onto the portion 43 after tightening the fastening screw 39. The connections can be produced in the conventional manner by snap-on fastenings or the like so that only the joints between the portions 42, 43 and 43, 44, respectively, are visible in the surface of the mounting part described with reference to FIGS. 5 to 7, which joints are hardly perceptible from a distance. According to FIG. 6, the portion 42 advisably has a mounting hole 45 through which the fastening screw 40 can be loosened or tightened also when the mounting is securely mounted should it be desired to unscrew or insert and then fasten the rod 36 from the side.

The described gearing also allows a very narrow construction of the lower part or of the entire holder part 3 in the direction of the second axis 29, since the driver pin 24 is arranged parallel to the first axis 17*a* and the roller 28 is arranged completely in front of the driver sleeve 17 as seen facing the mounting plate 15, so that the entire width of the door plate 2 can be kept within the width of approximately 34 mm required in frame doors. This is the case particularly when the driver pin 24 is arranged inside an imaginary cylinder corresponding to FIGS. 5 and 7, whose diameter is at most equal to the greatest diameter of the driver sleeve 17, since in this case the width of the roller 28 also needs to be, at most, great enough to correspond to the diameter of the imaginary cylinder. The gearing can nevertheless be constructed so as to be comparatively stable and the driver pin 24 can be given a comparatively large diameter since the guide parts 31,31*a* can be constructed so as to be comparatively steep. The height of this mounting part over the door leaf depends substantially only on the diameter of the roller 28 and on the strength of the arm 22. The distance of the two axes 17*a*, 29 has no influence on the height or on the width of the mounting, but rather only on the length of the door plate 2 since the two axes are situated substantially vertically one above the other in the mounted state.

Figure 10:
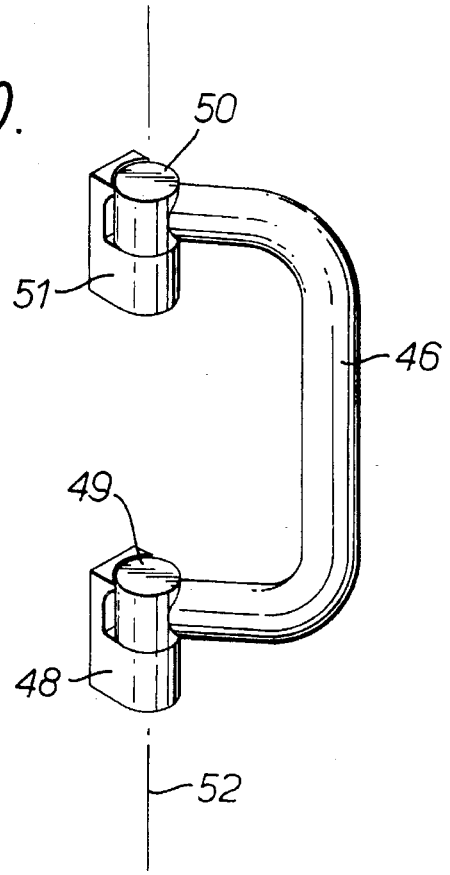
FIG. 10 shows a perspective view of a complete handle mounting which is particularly suitable for a smoke-protection door.

FIG. 10 shows a handle mounting for a smoke-protection door in a schematic view. The bottom portion of FIG. 10 shows the part of the mounting acting on a door lock, not shown, and the part of the mounting holding one end of a handle 46 and the top portion of FIG. 10 shows the part of the mounting holding the other end of the handle 46. The mounting contains a short, rigidly arranged holder part 48 for a gearing and a receptacle 49 for the handle 46. The receptacle 49 is rotatably supported at the holder part 48. The handle 46 is constructed as a handle bar which is fastened substantially vertically at the door leaf in the mounted state. The handle 46 is fastened at the other end to a second receptacle 50 which is rotatably supported in another rigid holder part 51. A rotational axis for the handle 46 is designated by 52. When the handle 46 is mounted this rotational axis 52 is arranged so as to be substantially vertical and accordingly also perpendicular to the movement direction of the latch or bolt and so as to be perpendicular to the axis of rotation of a conventional lock nut.

Figure 11:
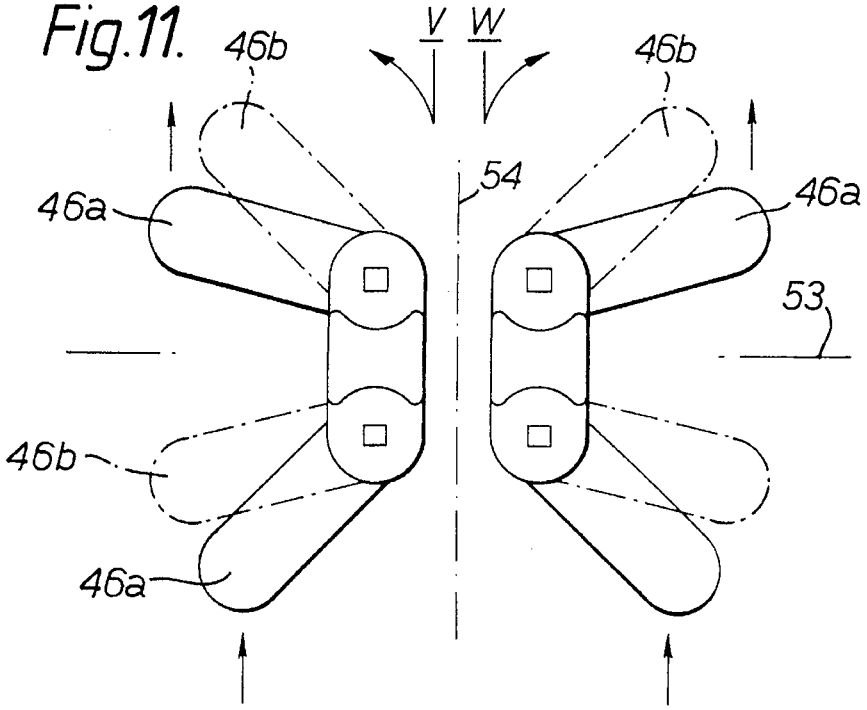
FIG. 11 is a schematic top view of the possible swiveling movements of the handle of the mounting according to FIG. 10.

FIG. 11 is a schematic view of imaginary center planes 53 of two smoke-protection doors which are situated on each side of a plane 54 arranged perpendicular to the center plane 53. By way of example, the left-hand side of FIG. 11 shows a door which opens in the direction of an arrow V or to the right. The right-hand side of FIG. 11 on the other hand shows a door opening in the direction of an arrow W, or to the left. The handle 46 is shown in a closed position 46*a*, indicated by solid lines, from which it must be swiveled in the direction of the respective arrow into an open position 46*b* shown in dashes so as to open the latch and then the door. This shows that the handle 46 should be situated at a comparatively slight distance from the center plane 53 in its normal closed position 46*a*, preferably on the side of the door on which the handle is pulled, so as to obtain a favorable lever action and exploitation of force as is shown in FIG. 11 for the two upper handles. On the other hand, if pressure is to be exerted on the handle 46 for the purpose of opening the door or its latch, which is the case with the two lower handles in FIG. 11, the handle 46 should form a greater angle up to approximately 45° with the center plane 53 in its closed position 46*a* to achieve a favorable lever action. The distance between the handle 46 and the door leaf must be at least great enough in all positions 46*a*, 46*b* to prevent injury when operating the door.

Figure 12:
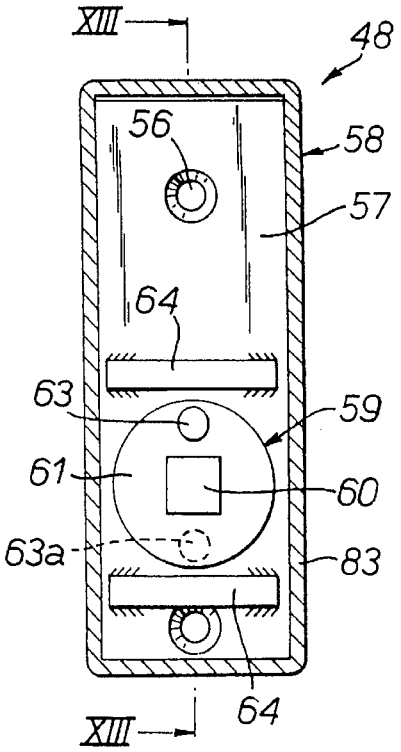
FIG. 12 is a front view in longitudinal section through the part of a handle mounting according to FIG. 10 for a smoke-protection door having a gearing according to the invention, which part acts on a door lock, only a first part of the gearing is shown.
Figure 13:
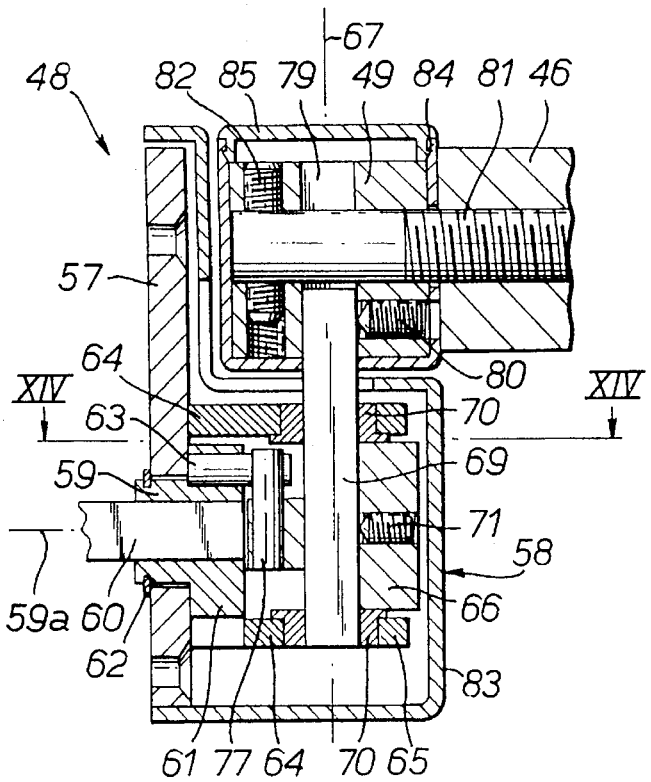
FIG. 13 shows a section along line XIII—XIII of FIG. 12.
Figure 14:
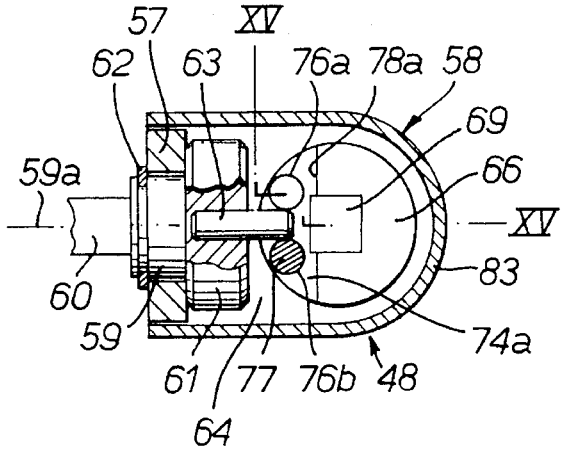
FIG. 14 shows a section along line XIV—XIV of FIG. 13.

According to FIGS. 12 to 14, the holder part 48 contains a lower part with a mounting plate 57 intended for mounting on a door and having screw holes 56 and an outer cover which is designated in its entirety by 58. The mounting plate 57 is provided with a circular opening in which a rear cylindrical portion of a first gearing part in the form of a driver sleeve 59 is Supported so as to be rotatable around a first axis 59*a*. The driver sleeve 59 has a non-circular, preferably square, inner cross section and serves to receive an actuating member 60 having a correspondingly non-circular outer cross section, preferably a conventional square spindle which projects through a lock nut and can be fastened in the driver sleeve 59 so as to be fixed with respect to axial displacement by means of a radially arranged fastening screw, not shown. Moreover, the driver sleeve 59 has a circular disk 61 at its inner end which is supported at the mounting plate 57 at the rear, while its other end is axially secured by a spring ring 62.

A driver pin 63 or the like whose axis is arranged parallel to and at a distance from the first axis 59*a* and which preferably projects perpendicularly away from the inner end face of the disk 61 parallel to the mounting plate 57 is arranged on the front side of the disk 61. Moreover, the driver pin 63 again lies within an imaginary cylinder whose diameter is at most equal to the greatest diameter of the driver sleeve 59.

Further, the lower part has two parallel holding plates 64 which project substantially perpendicularly from the mounting plate 57. The driver sleeve 59 is rotatably supported between these holding plates 64 (FIG. 12) which lie one above the other rather than adjacent to one another in contrast to FIGS. 5 to 7. The two holding plates 64 have coaxial bearing bore holes 65 (FIG. 13) for rotatably supporting a second gearing part which is constructed e.g. as a substantially cylindrical roller 66. The second gearing part is rotatable around a second axis 67 which is preferably arranged so as to be substantially perpendicular to the first axis 59a and substantially vertical in the mounted state of the mounting according to FIG. 13 when the actuating member 60 is perpendicular to the door leaf, as is conventional.

Figure 5:
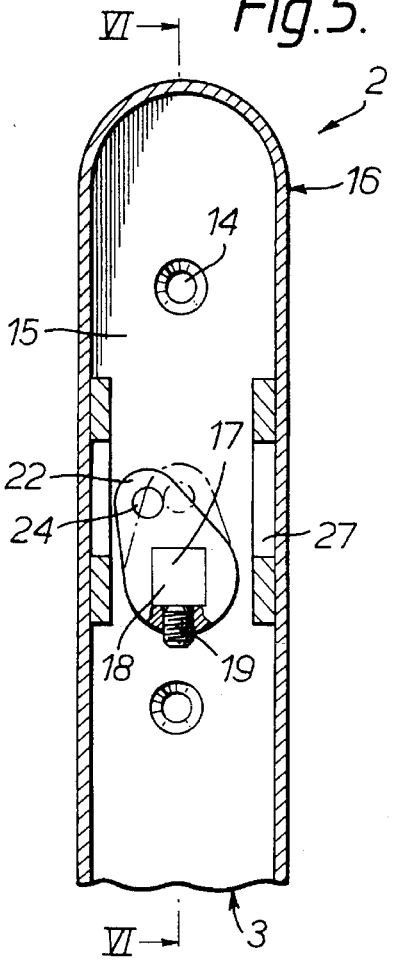
FIG. 5 is a front view in longitudinal section through the part of a handle mounting according to FIG. 1 for a panic door having a gearing according to the invention, which part acts on a door lock, only a first part of the gearing is shown.
Figure 6:
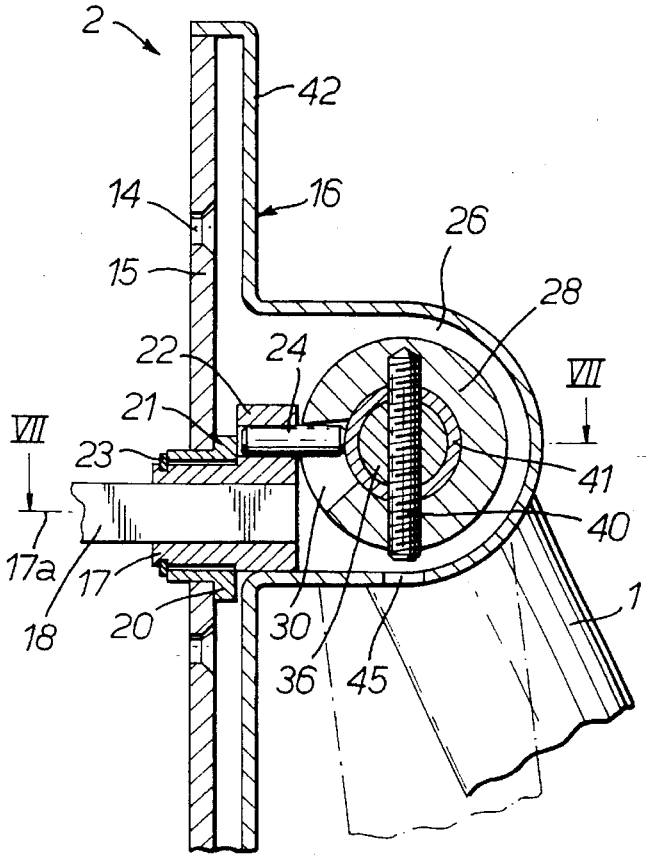
FIG. 6 shows a section along line VI—VI of FIG. 5 through the overall construction.
Figure 7:
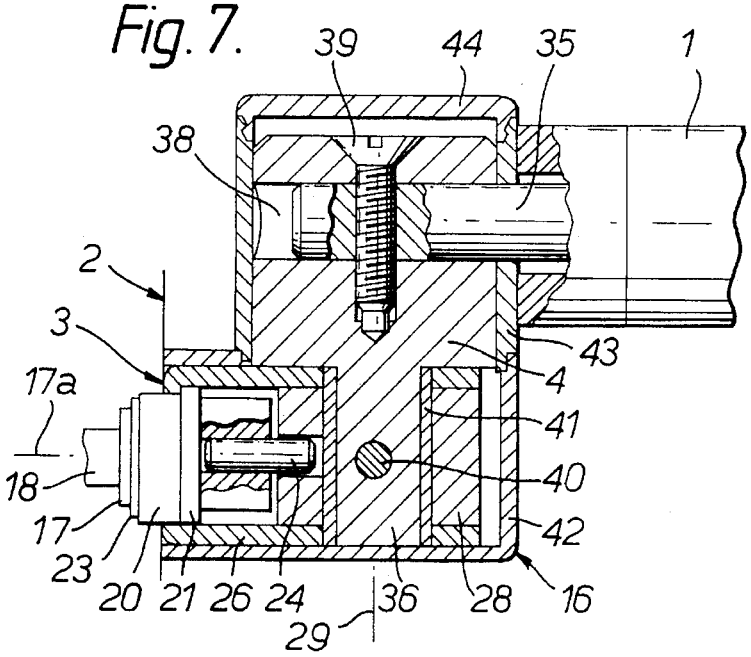
FIG. 7 shows a section along line VII—VII of FIG. 6.
Figure 8:
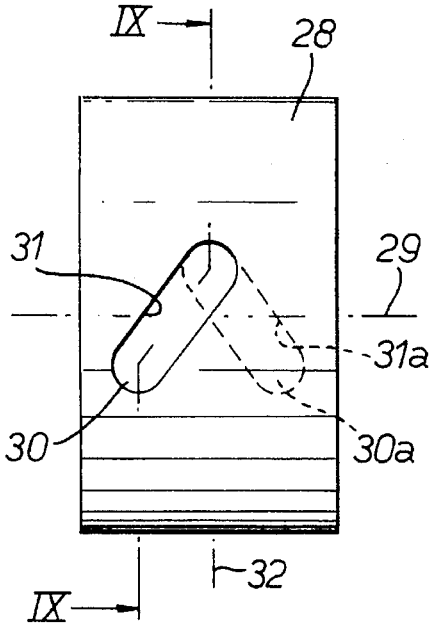
FIG. 8 shows an enlarged front view of a roller of the gearing according to FIGS. 6 and 7.
Figure 9:
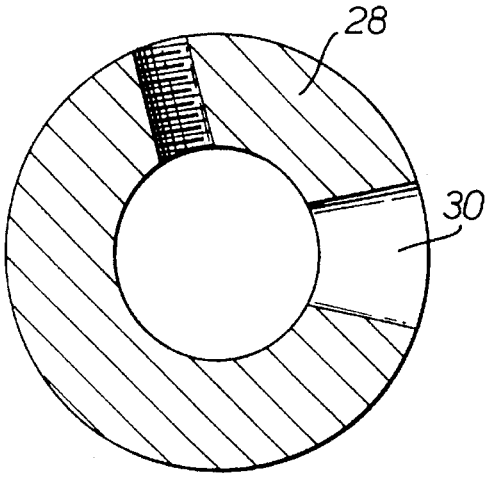
FIG. 9 shows a section along line IX—IX of FIG. 8.
Figure 15:
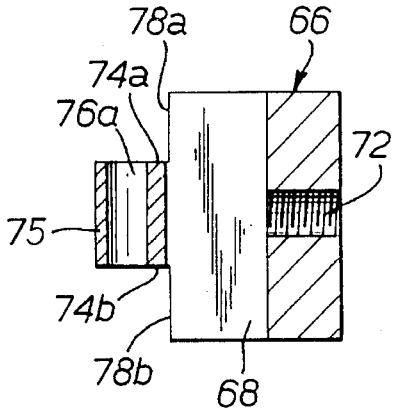
FIG. 15 shows a section which is enlarged compared to FIG. 13 only through a roller of the gearing.

As shown particularly by FIG. 15, the roller 66 contains a central passage 68 for receiving a rod 69 which can be supported in a manner similar to the rod 36 according to the embodiment form according to FIGS. 5 to 7 and can have the same function. However, as an alternative to this a cylindrical bearing sleeve 70 can also be supported in the bearing bore holes 65. The bearing sleeve 70 has e.g. a non-circular, particularly square, inner cross section and is supported at the inner sides of the holding plates 64 by a flange-like edge portion. In this case, the passage 68 has a corresponding inner cross section, while the rod 69 is constructed e.g. as a square spindle and with a corresponding outer cross section and projects through the passage 68 as well as the two bearing sleeves 70 and is accordingly connected with the latter so as to be fixed with respect to rotation relative to them.

A fastening screw 71 which is screwed into a radial threaded bore hole 72 of the roller 66 extending until the passage 68 serves as axial securing means. In this way the roller 66 is mounted and supported in a simple manner.

According to FIG. 15 the roller 66 is provided at both ends with recesses 74*a* and 74*b*, respectively, which have an arc-shaped cross section according to FIG. 14 and leave a likewise arc-shaped base 75. According to FIGS. 14 and 15 two continuous bore holes 76*a* and 76*b* are constructed in this base. Their axes are arranged parallel to the axis of the passage 68 and parallel to the second axis 67, respectively, and at a distance from one another in the circumferential direction of the roller 66.

The bore holes 76*a,b* optionally serve to receive a guide part 77, e.g. a cylindrical pin. As shown particularly by FIGS. 13 and 14, the arrangement is effected in such a way that the drive pin 63 projects parallel to the first axis 59*a* into one of the two recesses 74*a,b* until it is carried along in one or the other rotating direction, as desired, by the guide part 77 of the roller 66 when the roller 66 rotates around the second axis 67 and the driver sleeve 59 is accordingly rotated around the first axis 59*a*. The guide part 77 therefore acts as a guide for the driver pin 63 and replaces the guide parts 31, 31*a* according to FIG. 8 which are constructed as walls. Of course, the guide part 77 can also be a guide wall or the like formed on at the base 75 and/or at the outer surface area of the roller 66.

To realize the opening movements described with reference to FIG. 11, it is only necessary that the guide part 77 be inserted into the corresponding bore hole 76*a,b* with a press-fit and allowed to project into the corresponding recess 74*a,b*. Depending on which recess 74*a,b* the guide part 77 projects into, the disk 61 must be arranged in the position shown in FIG. 12 or rotated by 180° so that its driver pin 63 occupies the position 63*a* shown in dashed lines in FIG. 12. The other respective bore hole 76*a,b* preferably remains free, although inserting another guide part into it could serve to close the latch again when the roller 66 is moved backward. However, this is not usually necessary since the actuating member 60 is generally rotated back by the conventional restoring springs arranged in the lock so that the driver pin 63 contacts the guide part 77 and the roller 66 accordingly rotates the parts connected with it back into the closed position. In addition, the wall portions 78*a,b* formed by the recesses 74*a,b* and arranged parallel to the second axis 67 can also be used to rotate the driver pin 63 back into the initial position by rotating back the roller 66.

As a result of the described construction, the overall width of the mounting part as measured in the direction of an axis situated perpendicular to the axes 59a and 67 substantially depends only on the greatest diameter of the driver sleeve 59 or on the diameter of the roller 66 which is advisably dimensioned so as to be correspondingly large (FIG. 14).

The receptacle 49 is fastened at the rod 69. This receptacle 49 has a first passage 79 serving to receive the rod 69 and having a corresponding inner cross section and a threaded bore hole perpendicular to the latter for a fastening screw 80. The receptacle 49 also has a second passage extending perpendicularly relative to the first passage 79 and serving to receive e.g. a cylindrical mounting pin 81 which projects perpendicularly out of a respective end face of the handle 46. The mounting pin 81 has a transverse bore hole associated with a fastening screw 82 projecting through it. The fastening screw 82 is screwed into a threaded bore hole extending parallel to the first passage 79 and constructed in the receptacle 49 to connect the handle 46 with the receptacle 49 so as to be fixed with respect to rotation and axial displacement relative to it.

Moreover, the outer cover 58 is constructed from a number of parts similar to FIGS. 5 to 7 and has a rigid portion 83 receiving the lower part and the gearing, a portion 84 placed on the rotatable receptacle 49, and a portion 85 which is clipped onto the portion 84 after tightening the fastening screw 82.

As shown particularly in FIGS. 12 to 14, the gearing formed from the gearing parts 59 and 66 differs from the gearing according to FIGS. 5 to 7 formed by the gearing parts 17 and 28 substantially in that its second rotational axis 67 is perpendicular to the second rotational axis 29. However, the two second axes 29, 67 are arranged so as to be perpendicular to the same first axis 117*a* and 59*a*, respectively, and the two driver pins 24 and 63 are arranged so as to be parallel to the first axis 17*a*, 59*a* so that the mounting according to FIGS. 12 to 14 in itself would have to be substantially wider than the mounting according to FIGS. 5 to 7. However, this is prevented in the gearing according to FIGS. 12 to 14 in that the roller 66 has been rotated by 90° so that the holding plates 64 are arranged one above the other rather than adjacent to one another and in that the second axis 67 is arranged in such a way that it substantially intersects the first axis 59*a*, i.e. is not at a distance from it. Moreover, the guide part 31, 31*a* is replaced by the guide part 77. Accordingly, the gearing according to FIGS. 12 to 15 enables a sufficiently small overall width for frame doors as well as sufficient stability.

Figure 16:
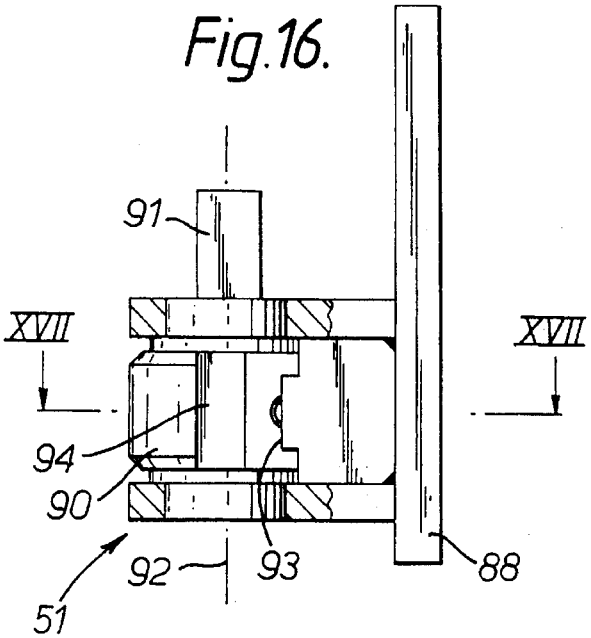
FIG. 16 is a side view in partial section of a part of the mounting according to FIGS. 1 or 10 arranged at the opposite end of the handle.
Figure 17:
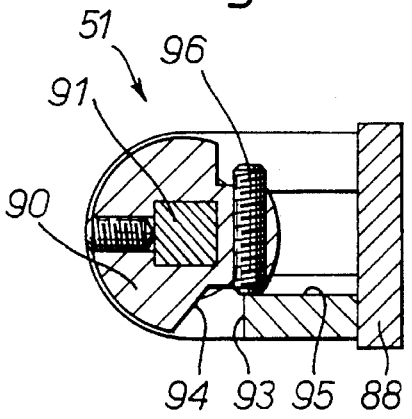
FIG. 17 shows a section along line XVII—XVII of FIG. 16.

The holder part 51 which is shown particularly in FIGS. 16 and 17 also serves to support the upper end of the handle 46 in FIG. 10 in a rotatable manner. It contains a lower part with a mounting plate 88 having screw holes and two holding plates 89 which project perpendicularly from the latter, a roller 90 being supported between the two holding plates 89 so as to be rotatable. This support is advisably effected with the aid of bearing sleeves similar to bearing sleeves 70 and by a rod 91 which projects through the bearing sleeves and the roller 90 and is constructed e.g. as a square spindle. The arrangement is effected in such a way that the second axis 67 (FIG. 13) is coaxial with a rotational axis 92 of the roller 90 and rod 91 in the mounted state.

In a manner analogous to FIG. 13, the receptacle 50 corresponding to the receptacle 49 can be fastened to an end of the rod 91 projecting out of one of the holding plates 89 in an upward or downward direction. The upper handle end is rotatably supported at the receptacle 50 in a corresponding manner. The holder part 51 advisably has a first stop 93, which cooperates with a stop face 94 worked into the circumference of the roller 90, and a second stop 95. This second stop 95 cooperates with an adjusting screw 96 which is screwed into a threaded bore hole of the roller 90 which extends perpendicularly to the axis 92 along a secant and has an end projecting out of the roller 90 by a preselected distance and facing the stop 95. The first stop 93 and the stop face 94 serve to determine the travel of the rotating movement of the roller 90 or handle 46 in one direction, preferably in the direction of the closed position. On the other hand, the stop 95 and the adjusting screw 96 serve to adjust the travel of the rotating movement of the roller 90 and handle 46 in the opposite direction, preferably in the direction of the open position, to a preselected value regardless of the type of door lock used in any particular instance. The stops thus provide the advantage that the end positions of the handle 46 are determined by the holder part 51 and not by the door lock and the latter is protected against overloading.

The holder part 6 (FIG. 1) can be connected with a roller corresponding to the roller 28 in a manner analogous to FIGS. 5 to 7 and this roller can be connected with a receptacle having a construction corresponding to the receptacle 4. In this case, also, corresponding stops for limiting the rotating movement can be associated with the stops according to FIGS. 16 and 17.

Finally, in order to preserve and/or reinforce the restoring springs provided in the door locks, at least one restoring spring could also be arranged in the holder parts 6 and 51, respectively, which restoring spring is tensioned when turning the handle into the open position and moves the handle back into the closed position when it is subsequently released.

Figure 18:
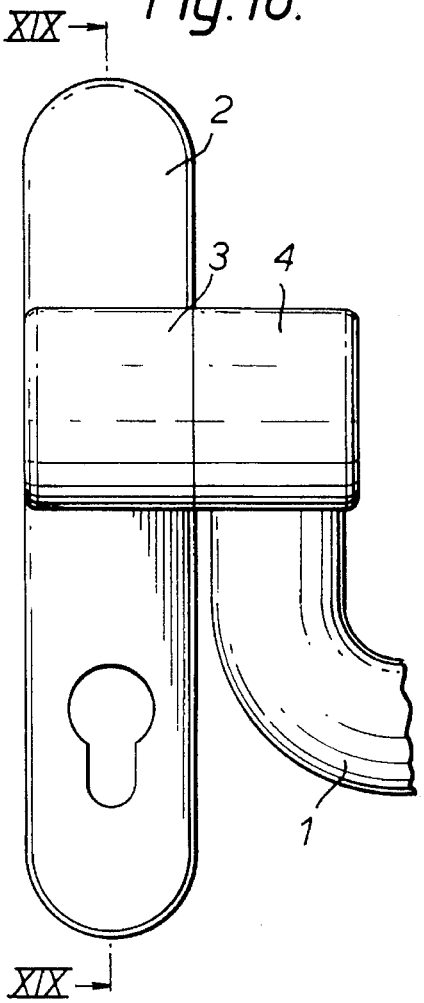
FIG. 18 shows a front view of the part of a handle mounting having a gearing according to FIGS. 12 to 15 applied in a panic door, which part acts on a door lock.
Figure 19:
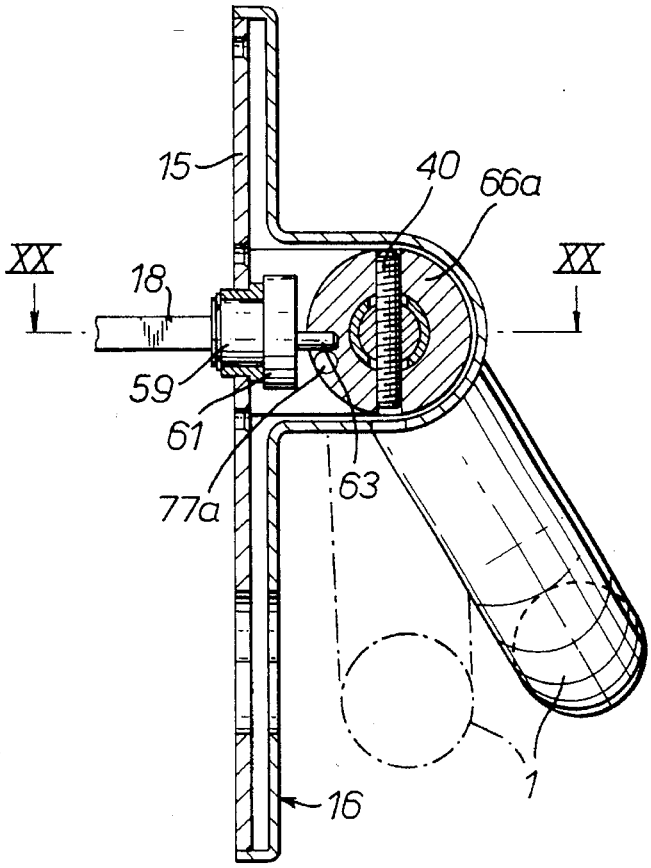
FIGS. 19 and 20 show sections along lines XIX—XIX of FIG. 18 and XX—XX of FIG. 19.
Figure 20:
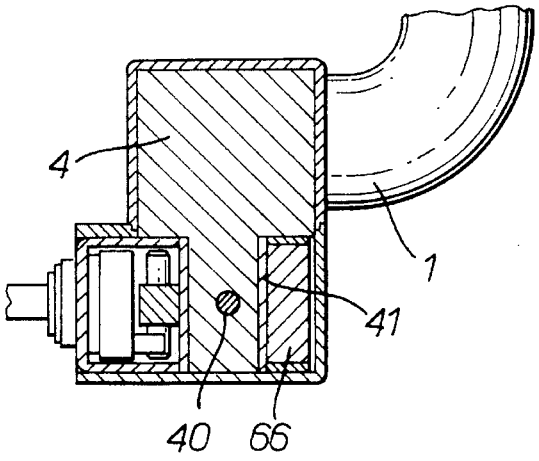
Figure 21:
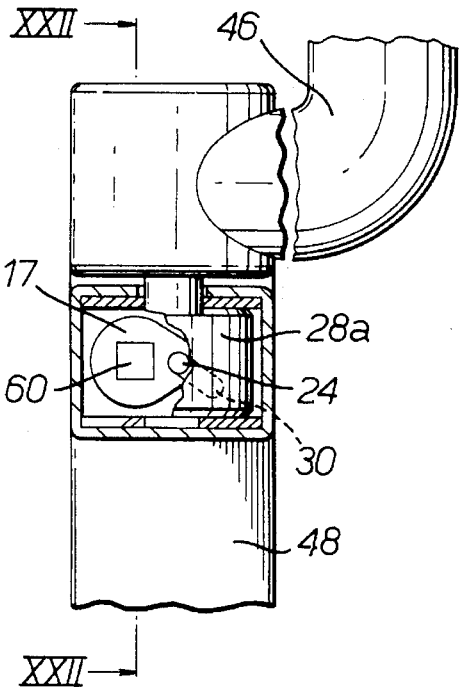
FIG. 21 shows a front view, in partial section, of the part of a handle mounting having a gearing according to FIGS. 5 to 9 applied to a smoke-protection door, which part acts on a door lock.
Figure 22:
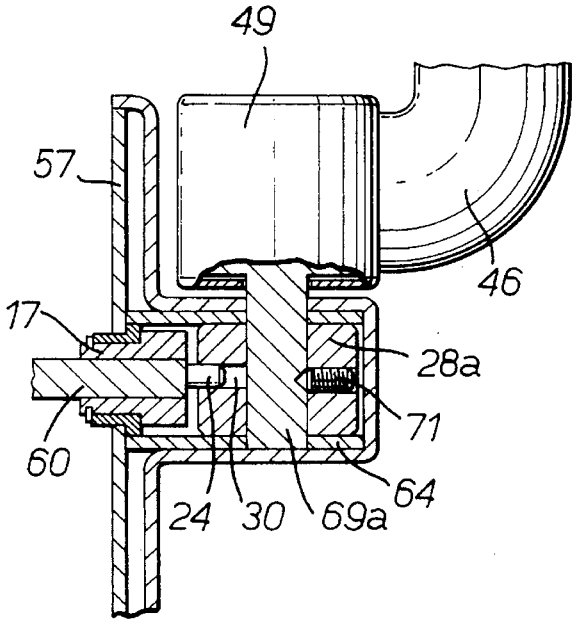
FIG. 22 shows a section along line XXII—XXII of FIG. 21.
Figure 23:
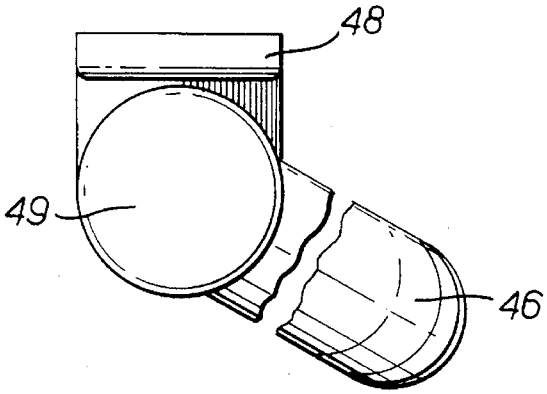
FIG. 23 is a top view of the mounting part according to FIG. 21.

If especially narrow mountings corresponding to FIGS. 5 to 9 and FIGS. 10 to 15 are not required it is of course possible to use their gearing in a position which is rotated by 90° without substantial modification. This is shown in FIGS. 18 to 20 in connection with a panic door for a gearing according to FIGS. 12 to 14, the same reference numbers being used for identical parts. Instead of the roller 66, only a roller 66*a* containing a guide part 77 is provided. The roller 66*a* has a cylindrical passage and is supported by a bearing sleeve similar to the bearing sleeve 41 according to FIG. 7. On the other hand, FIGS. 21 to 23 show the application of the gearing according to FIGS. 5 to 7 to a smoke-protection door or the like. Identical parts are again provided with the same reference numbers. In this case, a roller 28*a* is provided instead of the roller 28. The roller 28*a* is rotatably supported between the holding plates 64 only by a cylindrical rod 69*a*.

The invention is not limited to the described embodiment examples which can be modified in a number of ways. In particular, in a kinematic reversal of FIGS. 5 to 7 and 12 to 14, the driver pins could also be arranged at the second gearing part and the guide parts at the first gearing part. Further, it goes without saying that the individual members shown in FIGS. 5 to 9 can also be applied in an analogous manner in the embodiment form according to FIGS. 12 to 15 and vice versa. Further, the first gearing part could also act on other members as an actuating member for a lock nut, i.e. particularly on such members enabling an actuation of the latch or bolt in another manner. As an alternative to FIGS. 5 to 7, it could further be provided to insert the rod 36 into the roller 28 from the opposite side so as to arrange the receptacle 4 on the left-hand side of the holder part 3 according to FIG. 1. The rod 69 and the roller 66 could be arranged in a corresponding manner in the embodiment form according to FIGS. 12 to 14. It is also possible to mount the respective mounting plates 15, 57 in a position which is rotated by 180° around the axes 17*a*, 59*a* when the rest of the parts are adapted in a corresponding manner. Similar considerations apply to the embodiment examples according to FIGS. 18 to 23 and the holder parts 51 according to FIG. 16 which could also be situated e.g. below the rollers 90 like the free ends of the rods 91 in FIG. 16. Finally, the mounting pins 35 and 81 could be constructed as fixed structural component parts of the receptacles 4 and 49, respectively, in which case they would be inserted in corresponding receiving openings of the handles and then be connected with the latter by transverse pins or the like.

The application of the described gearing is not limited to the example shown in FIG. 4. Rather, particularly in connection with panic doors, double-wing doors with a moving and a stationary wing can also be provided. In so doing, the described gearing preferably acts on the lock of the moving wing, while another gearing can be provided in a manner known per se for acting on a driving rod actuating a bolt or latch.

We claim:

1. Gearing for a door lock having a lock actuating means and an actuating member (18, 60) therefor, particularly a panic or smoke-protection door lock, the gearing comprising a first gearing part (17, 59) having and being rotatable around a first axis of rotation (17*a*, 59*a*) and being connectable with said actuating member (18, 60); and a second gearing part (28, 66) which has and is rotatable around a second axis of rotation (29, 67) and is connectable with a handle (1, 46), the first axis of rotation (17*a*, 59*a*) and the second axis of rotation (29, 67) being arranged so as to be substantially perpendicular to one another and, for the purpose of converting a rotational movement of said second gearing part (28, 66) into a rotational movement of said first gearing part (17, 59) in at least one rotating direction, one of the gearing parts being provided with a driver pin (24, 63) which is arranged parallel to and at a distance from the axis of rotation (17*a*, 59*a*) of said one of said gearing parts while the other of said gearing parts is provided with a guide part (31, 31*a*, 77) cooperating with the driver pin.

2. The gearing according to claim 1, wherein the driver pin (24, 63) is provided at the first gearing part (17, 59) and the guide part (31, 31*a*, 77) is provided at the second gearing part (28, 66).

3. The gearing according to claim 1, wherein the gearing is mounted in a lower part having a mounting plate (15, 57) for fastening at the door and for rotatably supporting the first gearing part and two holding plates (26, 64) which project perpendicularly from the mounting plate (15, 57) and serve to support the second gearing part so as to be rotatable.

4. The gearing according to claim 1, wherein the second gearing part has a roller and the two holding plates (26, 64) have a bearing bore hole (67, 65) which is arranged coaxially relative to the second axis of rotation (29, 67) and serves for the rotatable support of the roller (28, 66).

5. The gearing according to claim 3, wherein the two plates (26, 64) have a bearing bore hole (67, 65) which is arranged coaxially relative to the second axis (29, 67) and serves for the rotatable support of the roller (28, 66), and a rod (36, 69) penetrating a center passage of a roller is supported in the bearing bore holes (27, 65) so as to be rotatable.

6. The gearing according to claim 5, wherein the rod (36, 69) is provided with a receptacle (4, 49) which projects out of one of the holding plates (26, 64) and serves for the mounting of the handle (1, 46).

7. The gearing according to claim 6, wherein bearing sleeves (70) with non-circular central openings are supported in the bearing bore holes (65) so as to be rotatable, the roller (66) has an axial passage with a correspondingly non-circular inner cross section, and the rod (66) is provided with a correspondingly non-circular outer cross-section.

8. The gearing according to claim 6, wherein the rod (69) has a non-circular outer cross section and the receptacle (49) has a first passage with a non-circular inner cross section corresponding to the outer cross section of the rod (69).

9. The gearing according to claim 8, wherein the receptacle (4, 49) has a second passage (38) for receiving a fastening member (35, 81) anchored in the handle (1, 46), which second passage (38) is arranged so as to be substantially perpendicular to the first passage.

10. The gearing according to claim 9, wherein said distance is at most equal to a greatest diameter of said one of the first and second gearing parts.

11. The gearing according to claim 5, wherein bearing sleeve (41) which projects through a central passage of the roller (28) and receives the rod (36) is supported in the bearing bore holes (27) so as to be rotatable.

12. The gearing according to claim 11, wherein at least the roller (28) and the bearing sleeve (41) are provided with radial bore holes for receiving fastening members (40) so that the roller (28) is connected with the rod (36) so as to be fixed with respect to rotation and axial displacement.

13. The gearing according to claim 1, wherein the first axis of rotation (17*a*) and the second axis of rotation (29) are arranged at a distance from one another and do not intersect one another.

14. Gearing for a door lock having a lock actuating means and an actuating member (18, 60) therefore, particularly a panic or smoke-protection door lock, the gearing comprising a first gearing part (17, 59) having and being rotatable around a first respective axis of rotation (17*a*, 59*a*) and being connectable with said actuating member (18, 60); and a second gearing part (28, 66) which has and is rotatable around a second respective axis of rotation (29, 67) and is connectable with a handle (1, 46), the first axis of rotation (17*a*, 59*a*) and the second axis of rotation (29, 67) being arranged so as to be substantially perpendicular to one another and, for the purpose of converting a rotational movement of said second gearing part (28, 66) into a rotational movement of said first gearing part (17, 59) in at least one rotating direction, one of the gearing parts being provided with a driver pin (24, 63) which is arranged parallel to and at a distance from the respective axis of rotation (17*a*, 59*a*) of said one gearing parts while the other gearing part is provided with a guide part (31, 31*a*, 77) cooperating with the driver pin and has a roller arranged with its axis coaxially to the axis of rotation of said other gearing part, the guide part (31, 31*a*, 77) being worked into an outer peripheral area of the roller.

15. The gearing according to claim 14, wherein the guide part (31, 31*a*) is a straight-line guide arrangement at an inclination relative to the second axis of rotation (29).

16. The gearing according to claim 14, wherein the guide part (31, 31*a*) is formed from wall portions defining an elongated hole arranged at an inclination relative to the second axis of rotation (29) for the purpose of converting the rotating movement of the handle (1) into a rotating movement of the actuating member (18) in opposite rotating directions.

17. The gearing according to one of claims 14 or 7, wherein the gearing is provided optionally with two rollers (28) for doors opening to the right or to the left, respectively.

18. The gearing according to claim 14, wherein the guide part (77) includes a pin which is substantially parallel to the second axis of rotation (67) and arranged inside a contour of said roller.

19. The gearing according to claim 18, wherein the guide part (77) is formed by a wall portion (78*a*,*b*) of a recess (74*a*,*b*) constructed in an outer surface area of the roller (66).

20. The gearing according to claim 19, wherein the recess (74*a*,*b*) has an arc-shaped cross section and the guide part (77) is formed by a pin having an axis arranged parallel to and at a distance from the second axis of rotation (67).

21. The gearing according to claim 20, wherein a base (75) defining the recess (74*a*,*b*) has two bore holes (76*a*,*b*) for optional insertion of the guide part (77).

22. The gearing according to claim 21, wherein the roller (66) has recesses (74*a,b*) at both ends which reach to the base (75) and the bore holes (76*a,b*) completely penetrate the base (75).

23. The gearing according to claim 18, wherein the first axis of rotation (17*a*) and the second axis of rotation (29) do not intersect one another.

* * * * *